US009856617B1

(12) United States Patent
Byer

(10) Patent No.: US 9,856,617 B1
(45) Date of Patent: Jan. 2, 2018

(54) SNOW GROOMER WITH LINKAGE FOR ADJUSTABLE COMPONENT

(71) Applicant: Richard L. Byer, Harbor Springs, MI (US)

(72) Inventor: Richard L. Byer, Harbor Springs, MI (US)

( * ) Notice: Subject to any disclaimer, the term of this patent is extended or adjusted under 35 U.S.C. 154(b) by 0 days.

(21) Appl. No.: 15/679,988

(22) Filed: Aug. 17, 2017

Related U.S. Application Data

(60) Provisional application No. 62/381,566, filed on Aug. 30, 2016.

(51) Int. Cl.
*E01H 4/02* (2006.01)

(52) U.S. Cl.
CPC ..... *E01H 4/02* (2013.01)

(58) Field of Classification Search
CPC ..... E01H 4/00; E01H 4/02
USPC ..... 37/217, 219, 220, 225; 404/96, 97; 172/796
See application file for complete search history.

(56) References Cited

U.S. PATENT DOCUMENTS 572,212 A * 12/1896 McGregor
1,144,444 A * 6/1915 Sutherland ..... E01H 4/02 37/196
4,056,328 A * 11/1977 Maxey ..... E01H 4/00 172/787
4,058,913 A * 11/1977 Esquilat ..... E01H 4/02 172/387
4,244,662 A * 1/1981 Olson ..... E01H 4/02 172/780
4,271,612 A * 6/1981 Mellingen ..... E01H 4/02 172/188
6,698,111 B2 3/2004 Lela
2002/0011012 A1* 1/2002 Gregoire ..... A63C 19/10 37/219
2011/0203143 A1* 8/2011 Audet ..... E01H 4/02 37/222

(Continued)

OTHER PUBLICATIONS

Snowgroomers.net, http://www.snowgroomers.net/htm/img_home4.htm, Trail Grooming Equipment, Sno-Master, datedJan. 14, 2005, first published in US in 2004.

(Continued)

*Primary Examiner* — John Weiss
(74) *Attorney, Agent, or Firm* — Timothy Engling

(57) ABSTRACT

A lightweight snow groomer designed to be towed behind a snowmobile, ATV, or UTV with an adjustable v-plow. The snow groomer includes multiple links pivotably connected to its drawbar assembly and the plow that allow the plow to swing upwardly and rearwardly under the drawbars. The snow groomer preferably includes a front link adjacent to its coupler for leveling the plow/pan assembly and for vertical adjustment to accommodate different hitch heights. The snow groomer also ideally has a lift assembly with a threaded arm that screws up and down the lift assembly. The linkage may include a slotted link segment that pivotably connects to the plow and allows the plow to float on compacted snow or leave the desired amount of snow, depending on the adjustment, for compacting. The preferred v-plow can swing upwardly and rearwardly when striking obstacles during operation of the snow groomer.

12 Claims, 7 Drawing Sheets

(56) References Cited

U.S. PATENT DOCUMENTS

2014/0003896 A1* 1/2014 Huet ..... B60P 1/02
414/540

OTHER PUBLICATIONS

Snowgroomers.net, http://www.snowgroomers.net/img/home3-600.jpg. Trail Grooming Equipment, Sno-Razor, datedJan. 14, 2005, first published in US in 2004.

* cited by examiner

SNOW GROOMER WITH LINKAGE FOR ADJUSTABLE COMPONENT

CROSS REFERENCE TO RELATED APPLICATION

This application claims priority benefit of U.S. provisional patent application No. 62/381,566 filed on Aug. 30, 2016, which is incorporated herein by reference.

FIELD OF THE DISCLOSURE

This disclosure relates to a snow grooming implement. More specifically, the disclosure relates to a snow groomer with a plow that can adjust relative to the compaction pan while leveling and compacting snow.

BACKGROUND

Long before snowplows and snow blowers, man compacted snow on trails and on roads of towns and villages. Large sleds or rollers powered by a variety of means have been used for centuries. Compacting snow and letting it set still provides groomed access to many arctic areas. "Icing-in" a road is still a common practice at many logging and construction sites in remote areas during the winter months.

Often, snow sport enthusiasts want to level drifts and low spots or to compact snow providing beautifully groomed access for their sport. Such sports include alpine skiing, snowboarding, tubing, sledding, snow shoeing, snowmobiling, and more recently biking.

One goal of snow grooming is producing a smooth, uniformly compacted snow surface with a uniform high density with easy-to-use equipment. Sometimes it may be desirable to reduce the amount of snow on a groomed trail or road for safety considerations. Large operations use snow cats and tractors to groom snow on a massive scale. But a snowmobile, an all-terrain vehicle (ATV) or utility task vehicle (UTV) can pull a smaller grooming drag for less expensive operations. In some instances, the trails are not wide enough for a large tractor or snow cat to groom the trails. Smaller groomers allow grooming trails with a standard snowmobile, ATV or UTV as an affordable grooming solution for many neighborhood, golf course and parks and recreation trail systems.

When using a utility snowmobile, a tracked ATV, or UTV to groom trails, the snowmobile, ATV, or UTV typically pulls a small grooming drag (such as about four feet wide) to engage the snow, while being easy to pull. The snowmobile, ATV, UTV and associated groomers are also less expensive than larger equipment. This may allow for more frequent grooming operations and grooming where enthusiasts may be enjoying the snow and trails.

The focus of this disclosure is snow grooming implements that can be used with snowmobiles to economically groom for snow sports, as well as for walking and hiking trails. Such implements are usually light-weight and can be towed at higher speed behind a snowmobile, ATV or UTV, rather than a large snow cat or tractor.

Certain prior art snow grooming drags have multiple spring tripping blades. As the blades cut off moguls, they can often hit rocks, stumps, or other fixed objects buried in the snow. While not all drags have spring tripping blades (rather they are mounted solid so they do not "trip" when hitting a buried solid object), certain prior art has each individual cutting blade as spring-loaded so they can trip out of the way if they hit a buried object. This can help prevent damage to the drag, vehicle, and the operator.

In addition to flat and compacted snow, sometimes it is desirable to reduce the amount of snow on a road or a trail for safety considerations. Deep snow can be problematic for the growing trend of winter biking. One innovation making winter biking easier is the popularity of fat tire bicycles—specialized mountain bikes equipped to ride on snow-covered roads and trails. A useful implement to groom roads or trails for winter biking is a v-plow.

Prior known v-plow groomers are attached by a single link from the front, which does not allow for lifting or adjusting the height of the plow. A lightweight snow groomer is desirable with a means of adjusting a plow relative to the compaction pan of the snow groomer.

SUMMARY

The present disclosure provides a groomer that includes some conventional components, but provides for a plow, such as a panned v-plow, that can move relative to the compaction pan, preferably where the plow swings upwardly and rearwardly upon too much resistance or hitting an obstruction during grooming operations.

Unlike known art, the disclosed snow groomer includes multiple links pivotably connected to the drawbar assembly and the plow, which allow the plow to swing upwardly and rearwardly. The multiple pivotable links can be three links with one link pivotably connected to a front portion of the plow and two links spaced apart and connected to a back portion of the plow.

The snow groomer preferably includes an adjustable front link for vertical adjustment to accommodate different snowmobile hitch heights and for keeping the v-plow level at the appropriate height. The front link can be used for leveling the plow/pan assembly.

The innovative, versatile, easy-to-use, low-resistance snow groomer allows economical trail grooming. Whether levelling and compacting mountain powder, hard-packed snow or wet slush, the disclosed versatile snow groomer will do the job quickly, in a wide range of conditions, with a snowmobile, an ATV, or a UTV.

BRIEF DESCRIPTION OF THE DRAWINGS

The above-mentioned and other features of this disclosure and the manner of obtaining them will become more apparent, and the disclosure itself will be best understood by reference to the following descriptions of methods considered in conjunction with the accompanying figures, which are given as non-limiting examples only, in which.

The exemplifications set out herein illustrate embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiments in different forms, the figures show, and herein described in detail, embodiments with the understanding that the present descriptions are to be considered exemplifications of the principles of the disclosure and are not intended to be exhaustive or to limit the disclosure to the details of construction and the arrangements of components and steps set forth in the following description or illustrated in the figures.

A practical goal for a snow groomer 10 is to maintain snowy surfaces as flat and as smooth as possible, and for some instances, such as winter biking, to reduce the amount of snow from a road or trail for safety considerations. For snowmobiles, ATVs or UTVs as small towing machines, groomers are a basic tool for surface grading, shaping, and packing snowy surfaces. The snow groomer 10 is lightweight meaning that it can be pulled by a small towing machine, instead of a snow cat or a tractor. Additional weights, such as cement blocks, can be added to the compaction pan 14 as needed.

Figure 1:
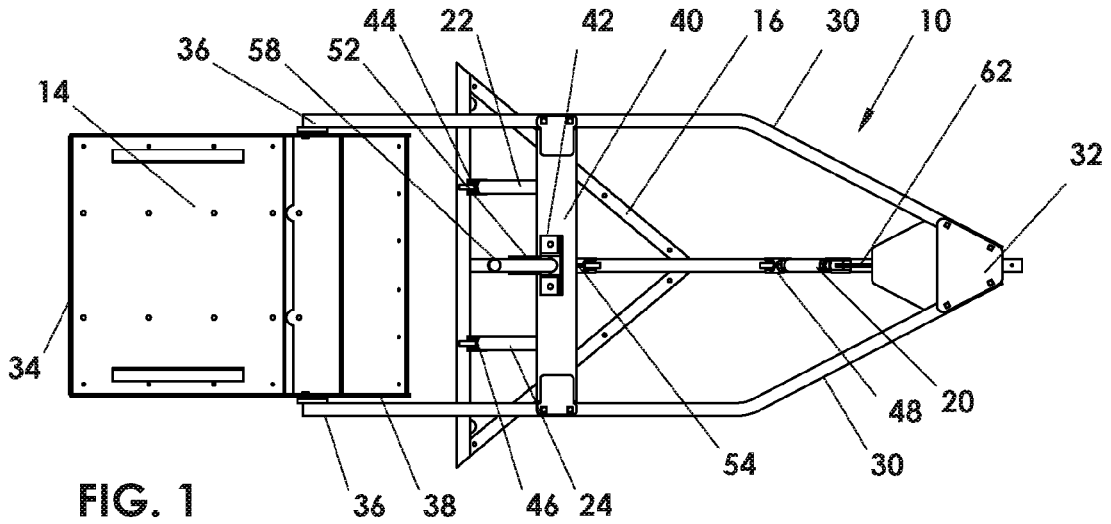
FIG. 1 shows a top view of a snow groomer with an example v-plow.
Figure 2:
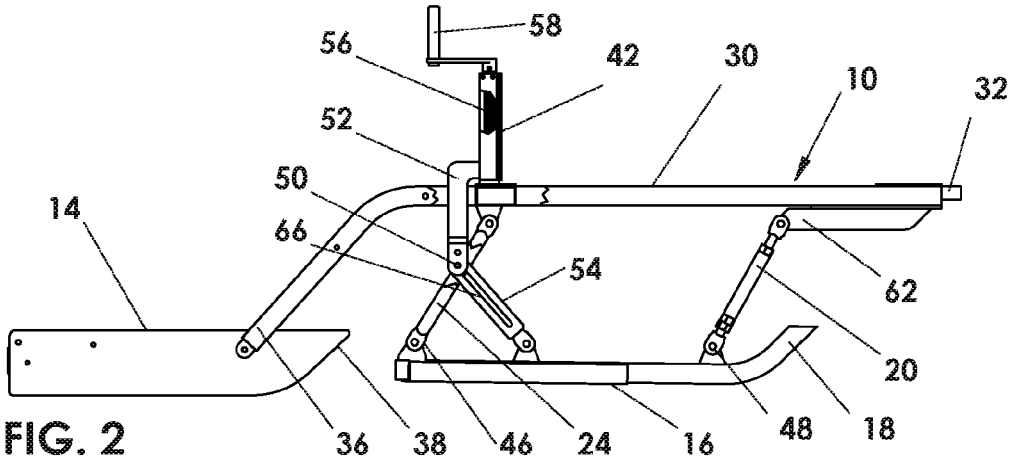
FIG. 2 shows a side view of the snow groomer with the plow in the default down position with a partial cutaway including a portion of the tower assembly and the front bar.
Figure 3:
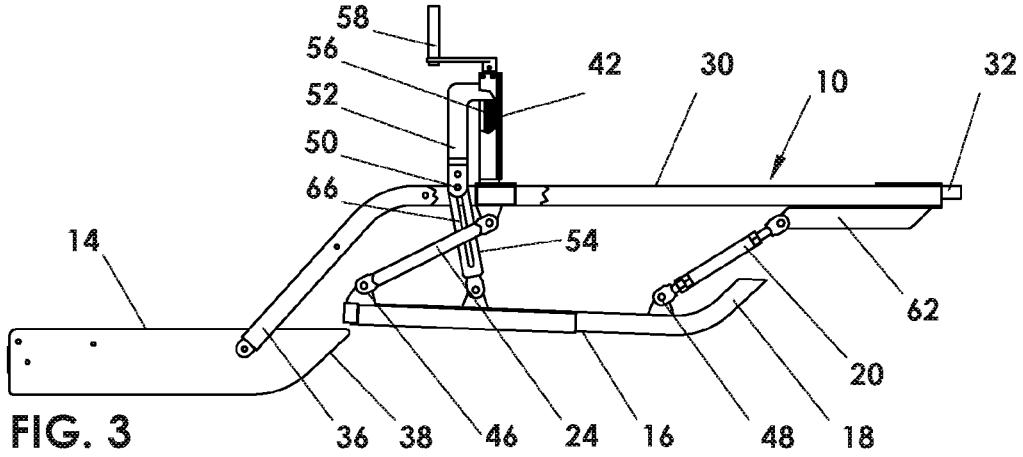
FIG. 3 shows a side view of the snow groomer with the plow swung upwardly and rearwardly with a partial cutaway.
Figure 4:
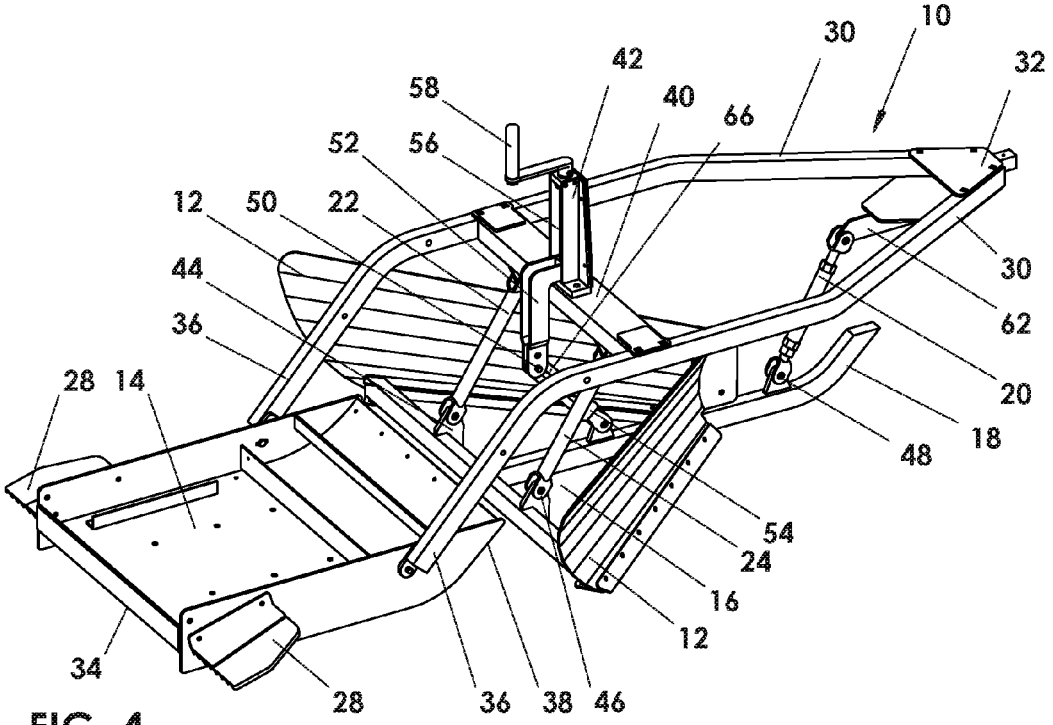
FIG. 4 shows a perspective view of the snow groomer with the plow lowered.
Figure 5:
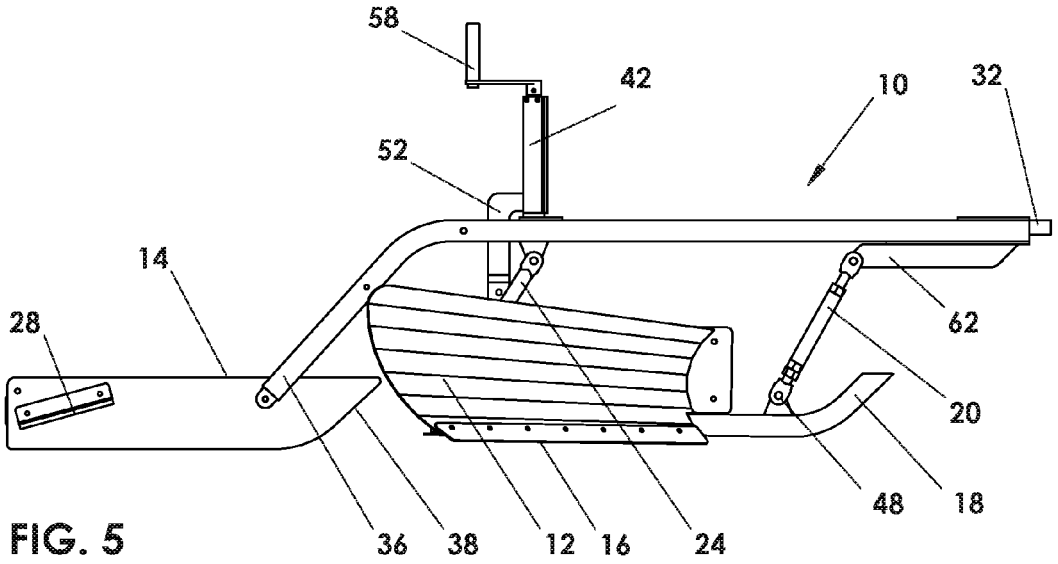
FIG. 5 shows a side view of the snow groomer with the plow lowered.

A snow groomer 10 has a compaction pan 14 (or packing pan) attached to the rear of the drawbars 30 and a plow 16 pivotably attached underneath the drawbars 30 via a plurality of links 20, 22 and 24, which allow the plow 16 to swing upwardly and rearwardly. The v-shaped plow 16 is preferably panned as shown in FIG. 1 with a ski runner 18 that can engage snow and deflect rocks, stumps or other obstacles when the snow groomer 10 is in operation. As shown in FIGS. 4 through 14, the plow 16 includes blades 12.

The drawbar assembly supplies a rigid frame onto which the various components are attached. The drawbars 30 will not bend or twist significantly when stressed by the operation and drag. The preferred metal components can be welded to form a tough structure, and then sand blasted and finally powder-coated for lasting durability.

The right and left drawbars 30 join at a hitchplate 32 (such as with a receiver for a break-away coupler) at the front of the drawbars 30 where it would hitch to the snowmobile, ATV, or UTV. Each drawbar 30 preferably angles downwardly toward the back distal end 36 where the drawbars 30 connect on each side to the compaction pan 14.

The compaction pan 14 provides for full width smoothing that leaves an evenly finished trail surface free of holes or depressions. The front 38 of the compaction pan 14 is angled forwardly to catch and spread the processed snow evenly across and under the compaction pan 14. The bottom of the compaction pan 14 can be substantially flat and covered with HDPE plastic. Wings 28 can extend outwardly to groom more widely. A rear-mounted snow comb 34 preferably grooms the snow into the desired pattern, such as a corduroy pattern.

A cross tube assembly 40 extends between the drawbars 30. The cross tube assembly 40 is adapted to mount a lift assembly 42 and two links 22 and 24.

Figure 6:
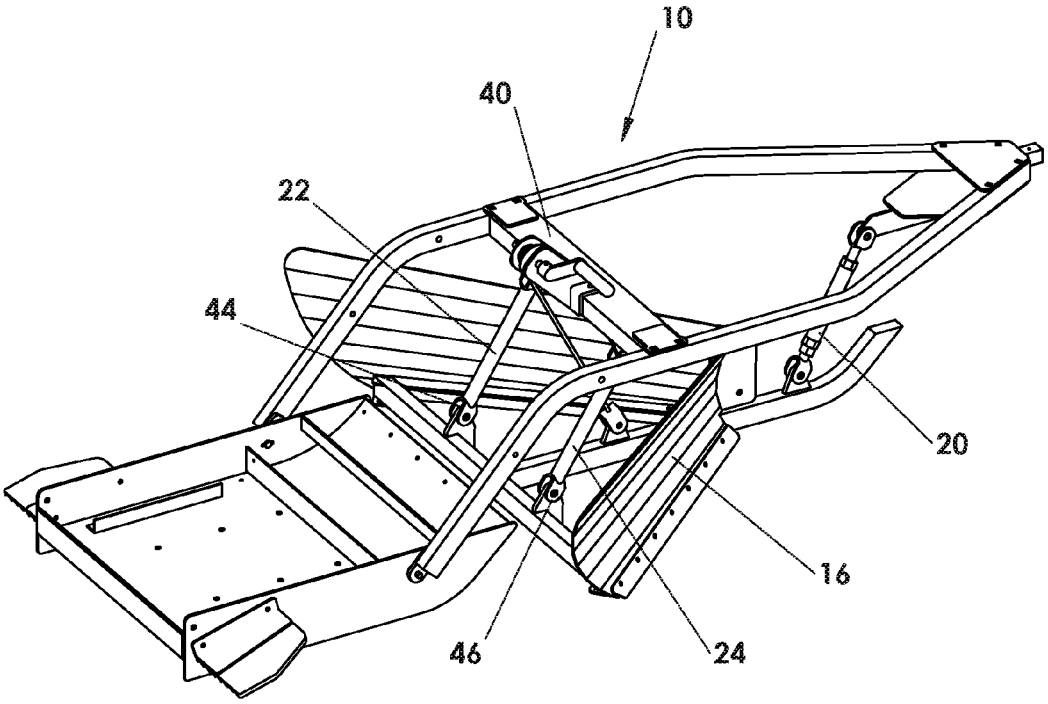
FIG. 6 shows a perspective view of the snow groomer having a cable actuator with the plow lowered.
Figure 7:
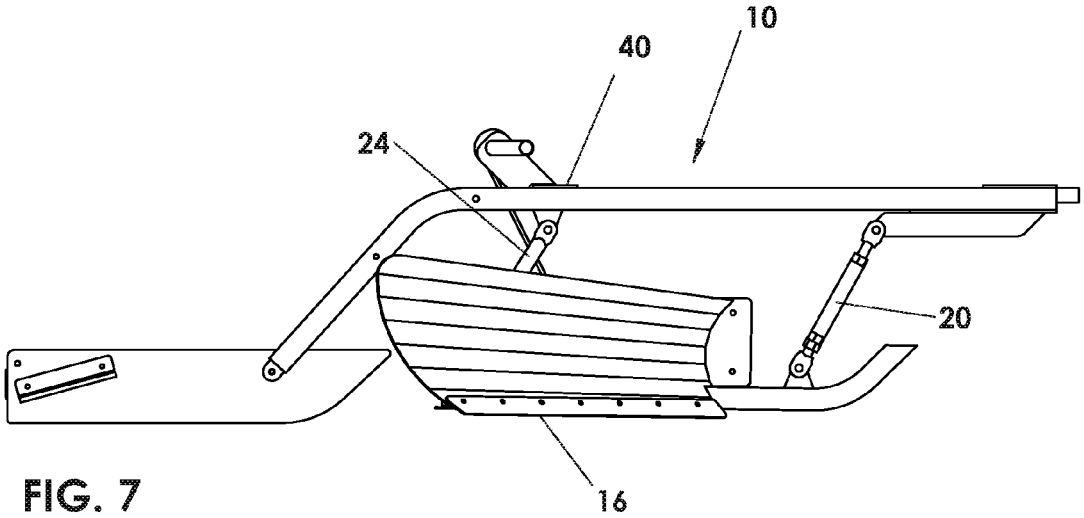
FIG. 7 shows a side view of the snow groomer having a cable actuator with the plow lowered.
Figure 8:
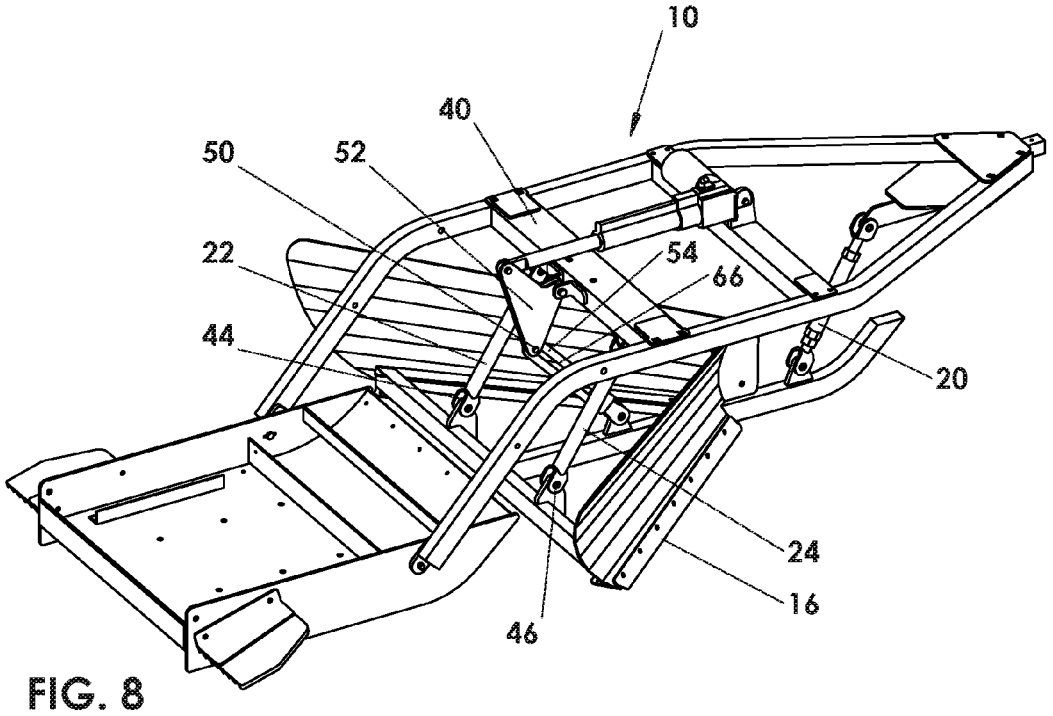
FIG. 8 shows a perspective view of the snow groomer having an electrical actuator with the plow lowered.
Figure 9:
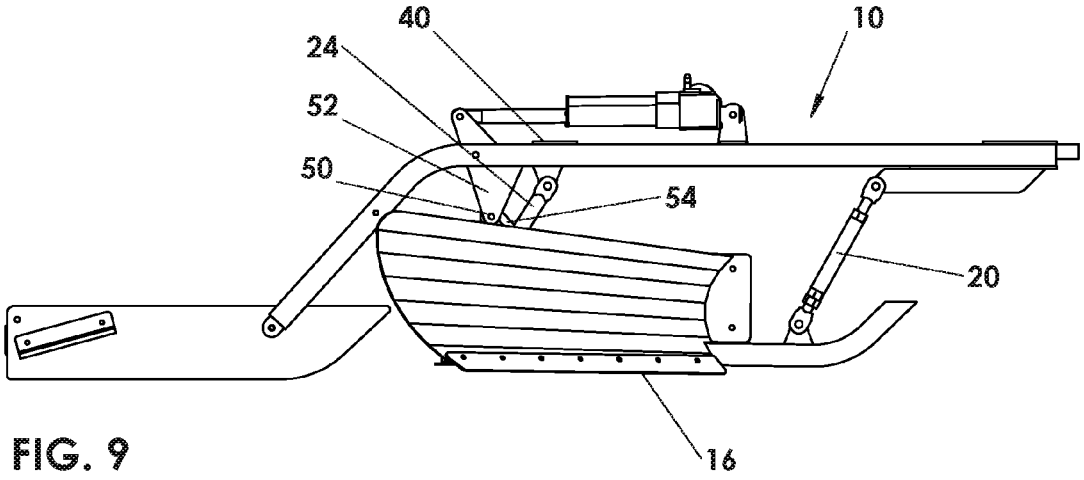
FIG. 9 shows a side view of the snow groomer having an electrical actuator with the plow lowered.
Figure 10:
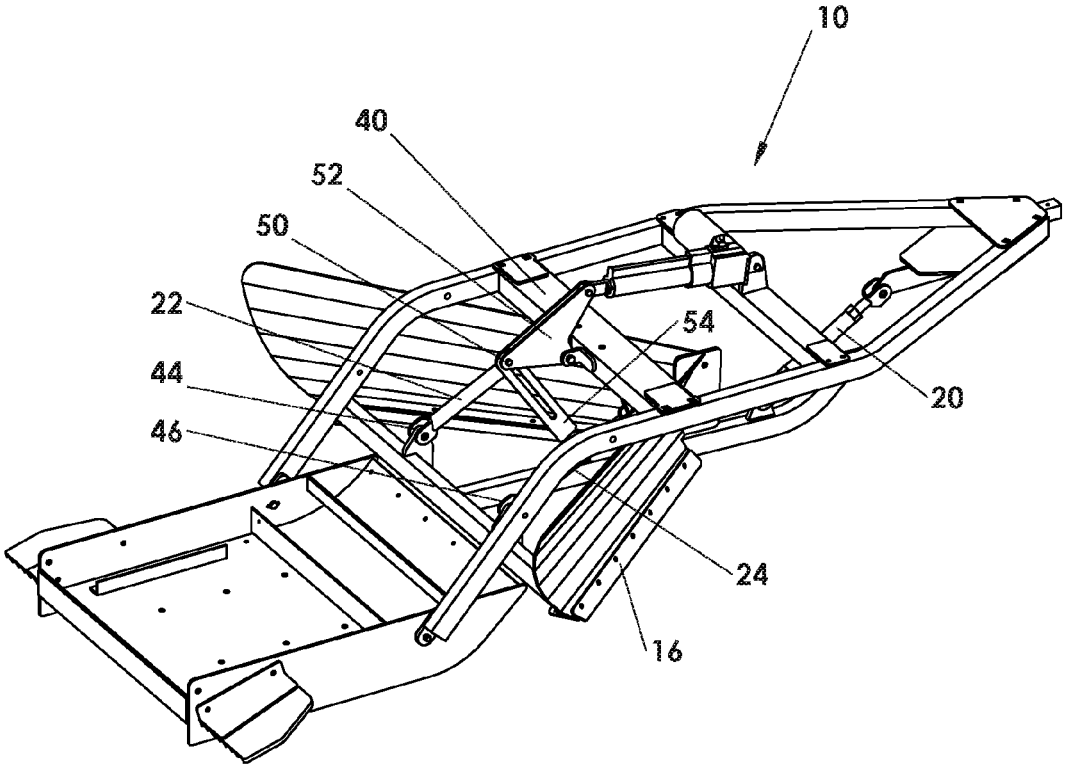
FIG. 10 shows a perspective view of the snow groomer having an electrical actuator with the plow raised.
Figure 11:
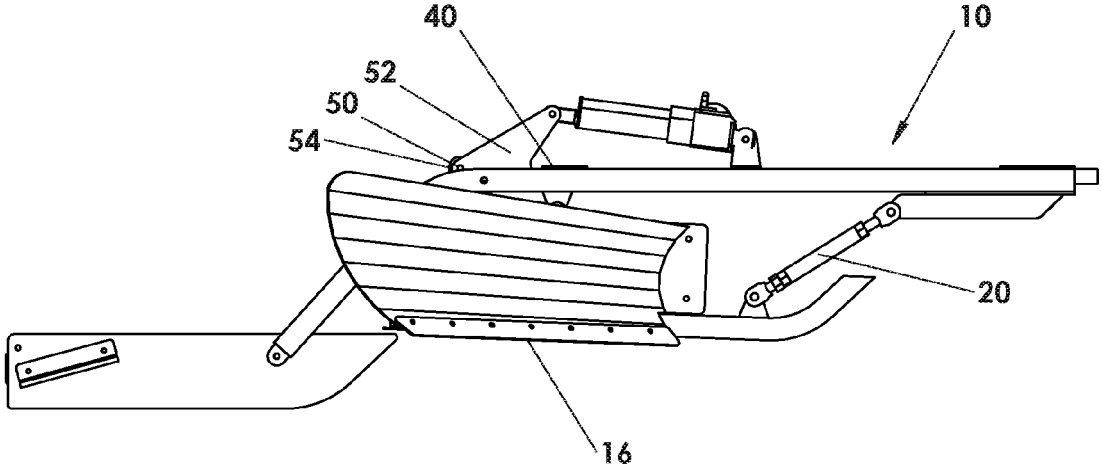
FIG. 11 shows a side view of the snow groomer having an electrical actuator with the plow raised.
Figure 12:
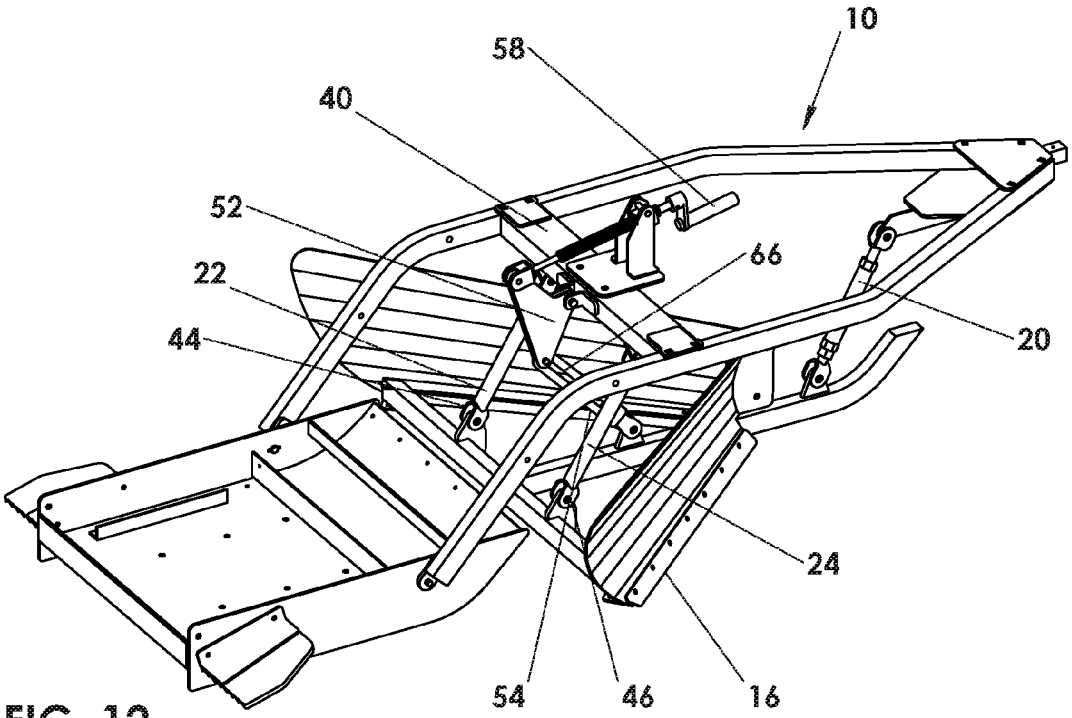
FIG. 12 shows a perspective view of the snow groomer having a hand crank with the plow lowered.

The lift assembly 42 may include a variety of lifting mechanisms. FIGS. 1 through 5 show a threaded lift tower. FIGS. 6 and 7 show a cable actuator as the lifting mechanism. FIGS. 8 through 11 include an electrical actuator, and FIG. 12 shows a hand crank, each used with a lifting link 52 pivotably attached to the cross tube assembly 40 and with a preferred link segment 54 having a slot 66, which can be elongated in the long axis of the link segment 54.

As shown in FIGS. 1 through 5, the lift assembly 42 include a lifting link 52, such as a screwed or threaded arm, that preferably moves up (such as screwing) the lift assembly 42 and is pivotably connected to a link segment 54 that pivotably connects to a center portion of the plow 16. The threaded lifting link arm can move vertically in a complementary screwed or threaded rod 56. A 12-volt actuator or a rotating handle 58 connected to the threaded rod 56 can raise or lower the lifting link 52 thereby raising or lowering the plow 16.

Figure 13:
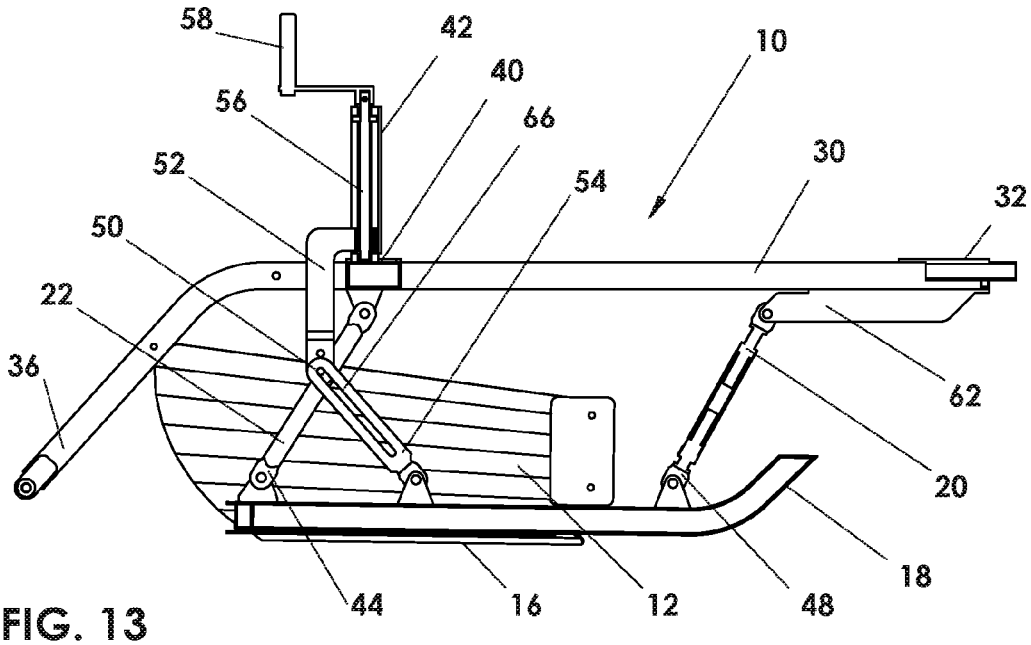
FIG. 13 shows a partial cut away side view of the link assembly of the snow groomer with the lifting link lowered.
Figure 14:
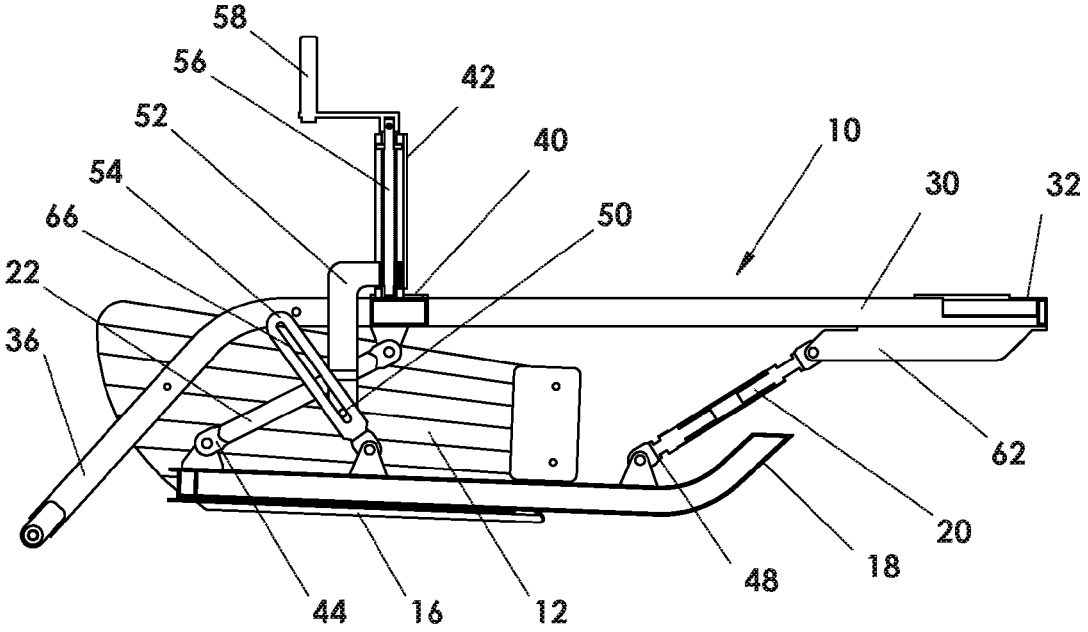
FIG. 14 shows a partial cut-away side view of the link assembly wherein the plow is moved upwardly such as from hitting an obstacle.

The lifting link 52 preferably includes a link pin 50 that runs in a slot 66 in the link segment 54 so the link segment 54 can pivot at the link pin 50, and the link pin 50 can slide within the slot 66 in its elongated direction to assist the plow 16 in vertically and preferably rearwardly adjusting relative to the cross tube assembly 40 when the plow 16 strikes an obstacle. FIGS. 13 and 14 show the lifting link 52 in the lowered position, but in FIG. 14, link pin 50 is at the bottom of slot 66 wherein the plow 16 moved upwardly such as after striking an obstacle.

The lift assembly 42 of the electrical actuator and hand crank examples of FIGS. 8 through 12 uses a lifting link 52 that is pivotably attached to the cross tube assembly 40 wherein the lifting link 52 is substantially triangular with one corner attached via the preferred link pin 50 to the link segment 54 as pivotably attached to the plow 16 at the opposing distal end. It also uses the preferred link segment 54 with a slot 66 in conjunction with a link pin 50 movable within the slot 66.

Next, each link 22 and 24 is pivotably connected to the cross tube assembly 40 as shown in FIG. 1. The bottom connections 44 and 46 of each link 22 and 24 respectively are pivotably connected to the plow 16. The pivotable bottom connections 44 and 46 are preferable connected to the back portion of the plow 16, spaced apart but ideally within the drawbars 30.

Another link 20 is pivotably connected to a front portion of the plow 16 at connection 48 preferably on a front extension from the v-shaped plow 16, wherein a Y-shaped assembly is formed. The top portion of the example adjustable front link 20 is preferably centrally and pivotably connected to center portion 62 of the lower hitchplate 32 adjacent to or part of the coupler system. The adjustable front link 20 can be used for leveling the plow/pan assembly.

The preferred adjustable front link 20 is primarily used to level or control the angle of the plow/pan assembly and is preferred to accommodate various hitch heights of the hitchplate 32, such as a hitch height range of 15-19 inches.

The three links 20, 22, and 24 in conjunction with the preferred lifting assembly 42 (including a cable or a pivotable pin 50 in a slot 66 of a link segment 54) allow the plow 16 to move upwardly and rearwardly in a swinging motion if the plow 16 hits an obstruction. The three links 20, 22, and 24 operate with an end of each pivotably attached to the drawbar assembly and the opposite end pivotably attached to the plow 16. The links 20, 22, and 24 could also be linearly resilient or even shock absorbers of the type used in automobiles.

The linkage system allows for vertical adjustment to accommodate different snowmobile hitch heights and for keeping the plow 16 level while moving.

The disclosed snow groomer 10 has the ability for the user to raise the plow 16 parallel to the drawbars 30. Contrary to prior art plows pulled only from the front of the plow structure with side-to-side movement and rotation around the pulling point, the disclosed adjustable three-link system keeps the plow 16 under control in all axes allowing a more level and uniform groomed trail.

This disclosure has been described as having exemplary embodiments and is intended to cover any variations, uses, or adaptations using its general principles. It is envisioned that those skilled in the art may devise various modifications and equivalents without departing from the scope of the disclosure as recited in the claims. Further, this disclosure is intended to cover such variations from the present disclosure as come within the known or customary practice within the art to which it pertains.

What is claimed is:

1. A snow groomer having a drawbar assembly for supporting components including a compaction pan, a coupler, and a plow that can move relative to the compaction pan, further including multiple links pivotably connected to the drawbar assembly and the plow that allow the plow to swing upwardly and rearwardly and a lift assembly to raise or lower the plow relative to the drawbar assembly, the lift assembly having a lifting link with a link pin, and a link segment with a slot, wherein the link segment can pivot at the link pin, and the link pin can slide within the slot to assist the plow in vertically moving when striking an obstacle.

2. The snow groomer of claim 1 including a front link adjacent to the coupler to accommodate different hitch heights of a towing machine.

3. The snow groomer of claim 1 wherein the plow is a panned v-plow.

4. The snow groomer of claim 3 wherein the multiple links include three links with one link pivotably connected to a front portion of the plow and two links spaced apart and connected to a back portion of the plow.

5. A snow groomer having a drawbar assembly for supporting components including a compaction pan, a coupler, and a plow that can move relative to the compaction pan, further including multiple links pivotably connected to the drawbar assembly and the plow that allow the plow to swing upwardly and rearwardly and a lift assembly having a screw and handle with a lifting link that screws up the lift assembly and is pivotably connected to a link segment that pivotably connects to the plow and the link segment includes a slot where connected to the lifting link.

6. The snow groomer of claim 5 wherein the plow is a v-plow.

7. A lightweight snow groomer adapted for use with a small towing machine, such as a snowmobile, UTV or ATV, having a drawbar assembly for supporting components including a compaction pan, a coupler, and a v-plow that can move relative to the compaction pan, further including links pivotably connected to the drawbar assembly and the v-plow that allow the v-plow to swing upwardly and rearwardly, the links include an adjustable front link pivotably connected to a front portion of the v-plow and two links spaced apart and connected to a back portion of the v-plow, and a lift assembly having a threaded rod with a lifting link that can screw up and down the threaded rod of the lift assembly to vertically adjust the v-plow and is pivotably connected to a link segment that pivotably connects to the v-plow.

8. The snow groomer of claim 7 wherein the link segment includes an elongated slot in which a link pin of the lifting link can move.

9. The snow groomer of claim 7 wherein the adjustable front link is used for leveling an assembly of the v-plow and the compaction pan.

10. A lightweight snow groomer including a drawbar assembly for supporting components including a compaction pan, a coupler, and a v-plow that can move relative to the compaction pan, further including links pivotably connected to the drawbar assembly and the v-plow that allow the v-plow to swing upwardly and rearwardly, the links include an adjustable front link pivotably connected to a front portion of the v-plow and links spaced apart and each connected to a back portion of the v-plow, and a lift assembly to raise or lower the v-plow relative to the drawbar assembly, the lift assembly having a lifting link with a link pin, and a link segment with a slot, wherein the link segment can pivot at the link pin, and the link pin can move within the slot to assist the v-plow in moving when striking an obstacle.

11. The snow groomer of claim 10 wherein the lifting link is pivotably attached to a cross tube of the drawbar assembly wherein the lifting link is substantially triangular with one corner attached via the link pin to the link segment as pivotably attached to the plow at an opposing distal end.

12. The snow groomer of claim 10 wherein the adjustable front link is used for leveling an assembly of the v-plow and the compaction pan.

* * * * *